United States Patent [19]

Frascaroli et al.

[11] Patent Number: 5,056,285

[45] Date of Patent: Oct. 15, 1991

[54] PARTITION WALL, PARTICULARLY FOR OFFICES

[75] Inventors: Francesco Frascaroli, Bologna; Edgardo Versari, Forli', both of Italy

[73] Assignee: C.O.M. Cooperativa Operai Mobilieri S.C.R.L., Persiceto, Italy

[21] Appl. No.: 215,646

[22] Filed: Jul. 6, 1988

[30] Foreign Application Priority Data

Jul. 6, 1987 [IT] Italy ..... 4912/87[U]

[51] Int. Cl.[5] ..... E04B 2/78

[52] U.S. Cl. ..... 52/243; 52/36; 52/238.1; 52/775

[58] Field of Search ..... 52/239, 36, 243, 775, 52/238.1; 160/135, 351

[56] References Cited

U.S. PATENT DOCUMENTS

| | | | |
|---|---|---|---|
| 3,189,140 | 6/1965 | Luss | 52/36 |
| 3,261,625 | 7/1966 | Cripe | 52/239 |
| 3,282,006 | 11/1966 | Halsey et al. | 52/239 |
| 3,513,606 | 5/1970 | Jones | 52/243 |
| 3,694,975 | 10/1972 | Pollock | 52/36 |
| 3,788,378 | 1/1974 | Sobel | 160/351 |
| 4,106,251 | 8/1978 | Nelsson | 52/775 |
| 4,109,429 | 8/1978 | Whisson | 52/239 |
| 4,205,815 | 6/1980 | Sauer et al. | 52/36 |
| 4,207,717 | 6/1980 | Hubbard | 52/775 |

FOREIGN PATENT DOCUMENTS

| | | | |
|---|---|---|---|
| 468454 | 10/1974 | Australia | 52/36 |
| 848658 | 8/1970 | Canada | 52/243 |
| 1759497 | 2/1979 | Fed. Rep. of Germany | 52/36 |
| 1316253 | 5/1973 | United Kingdom | 52/239 |

*Primary Examiner*—Michael Safavi

*Attorney, Agent, or Firm*—Frost & Jacobs

[57] ABSTRACT

A partition wall comprising a frame consisting of a number of vertical uprights and crosspieces, and covered on both faces by a number of panels.

The main characteristic of the present invention lies in the aforementioned upright being formed from a bent sheet metal section with clinched lateral edges defining a hollow, substantially rectangular center portion and two opposed, substantially C-shaped lateral portions with turned-in ends.

8 Claims, 4 Drawing Sheets

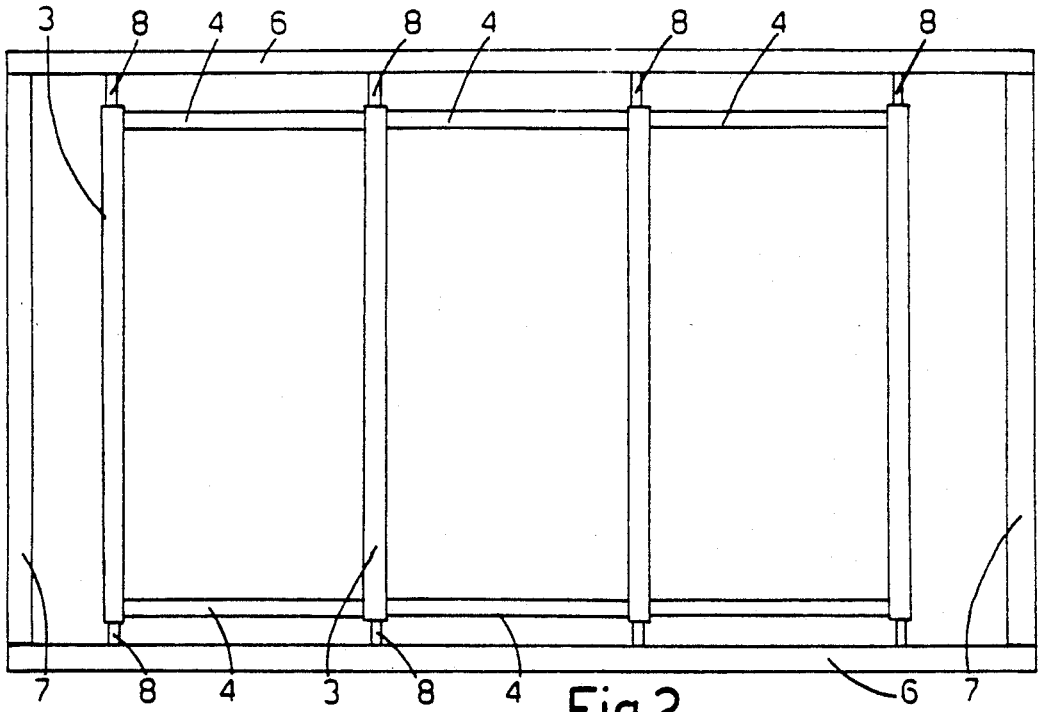
Fig.2
Fig.1
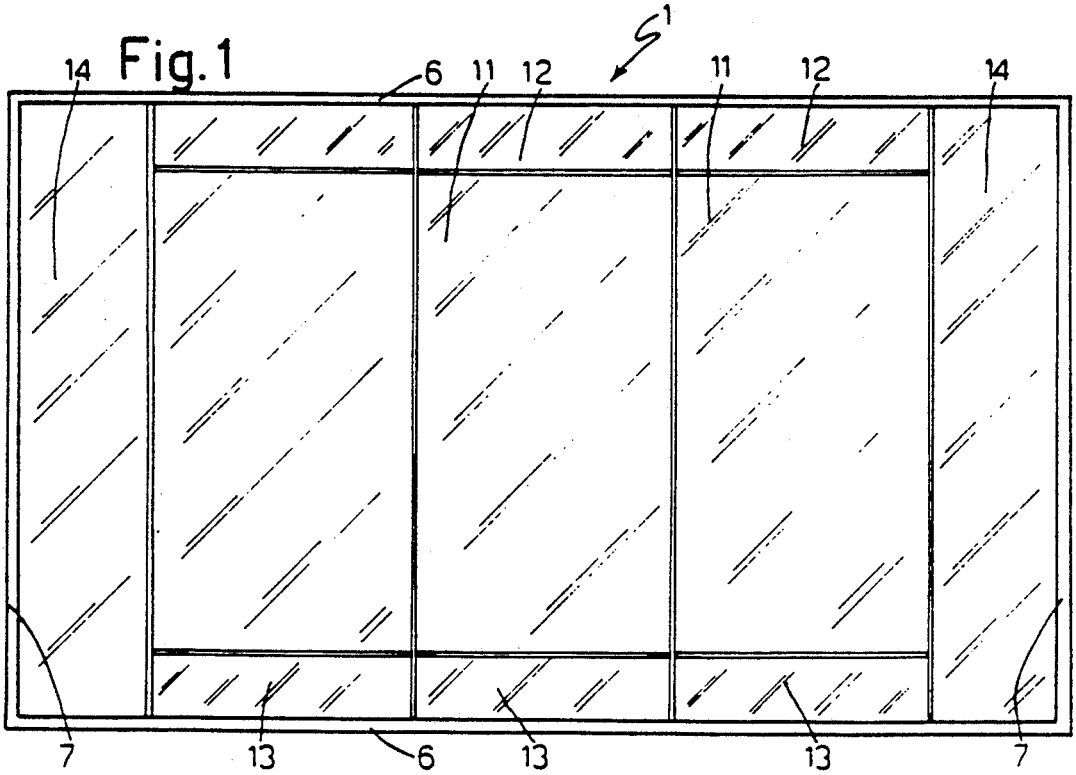

PARTITION WALL, PARTICULARLY FOR OFFICES

The present invention relates to a partition wall, particularly for offices.

SUMMARY OF THE INVENTION

The aim of the present invention is to provide a partition wall, particularly for offices, enabling fast, trouble-free assembly.

Further aims and advantages of the present invention will be disclosed in the following description. With this aim in view, according to the present invention, there is provided a partition wall, particularly for offices, comprising a frame having a number of pairs of vertical uprights connected by at least one crosspiece, and preferably covered by a number of panels supported on the said frame via first fastening means; characterised by the fact that the said upright is formed from a bent sheet metal section with clinched longitudinal lateral edges defining a hollow, substantially rectangular center portion and two opposed, substantially C-shaped lateral portions.

BRIEF DESCRIPTION OF THE DRAWINGS

A preferred embodiment of the present invention will be described by way of example with reference to the accompanying drawings, in which:

FIG. 1 shows a front view of the partition wall according to the present invention;

FIG. 2 shows a front view of the inner frame on the FIG. 1 partition wall;

DETAILED DESCRIPTION OF THE INVENTION

Figure 3:
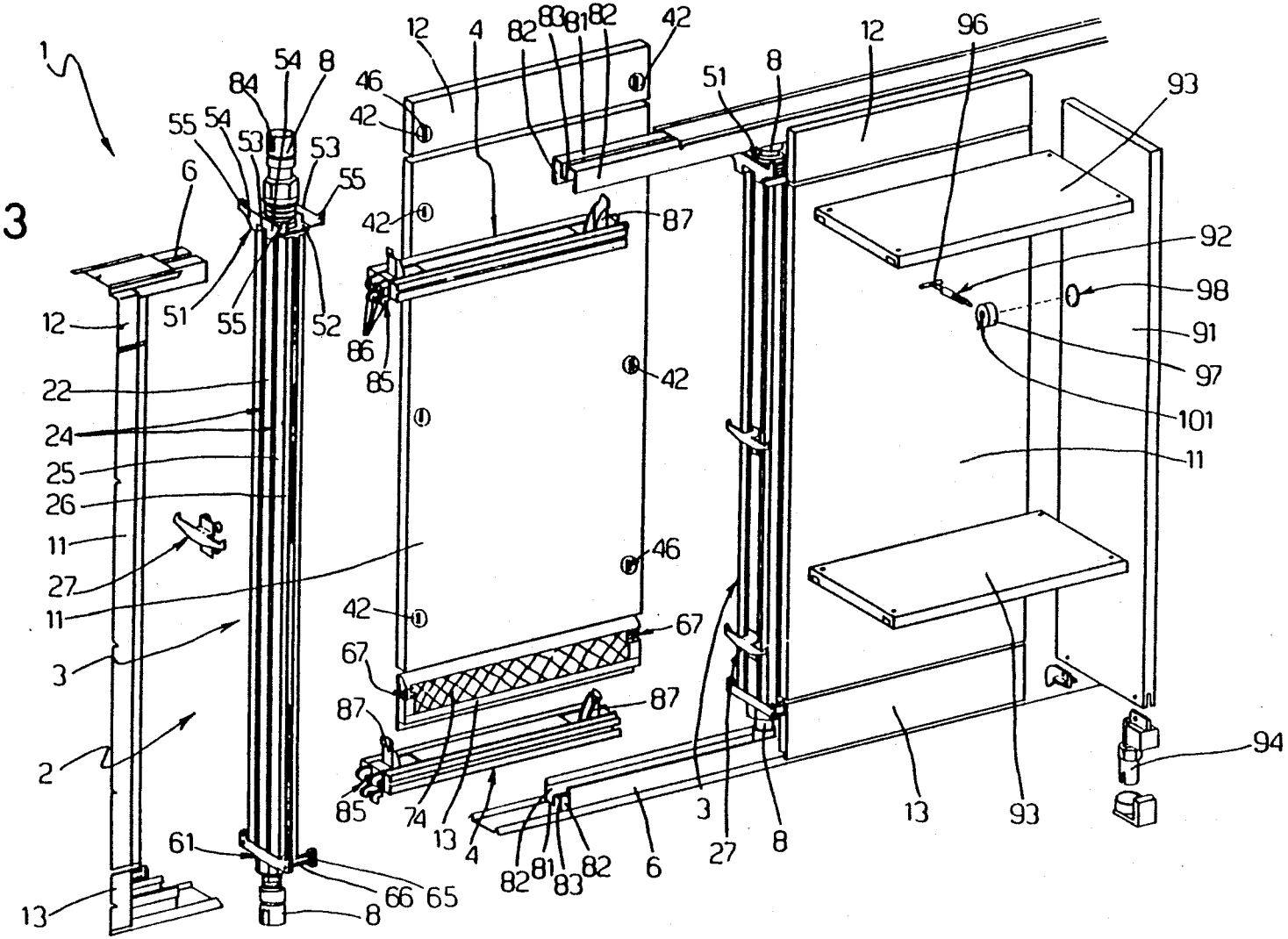
FIG. 3 shows an exploded view in perspective of part of the partition wall in FIG. 1.
Figure 5:
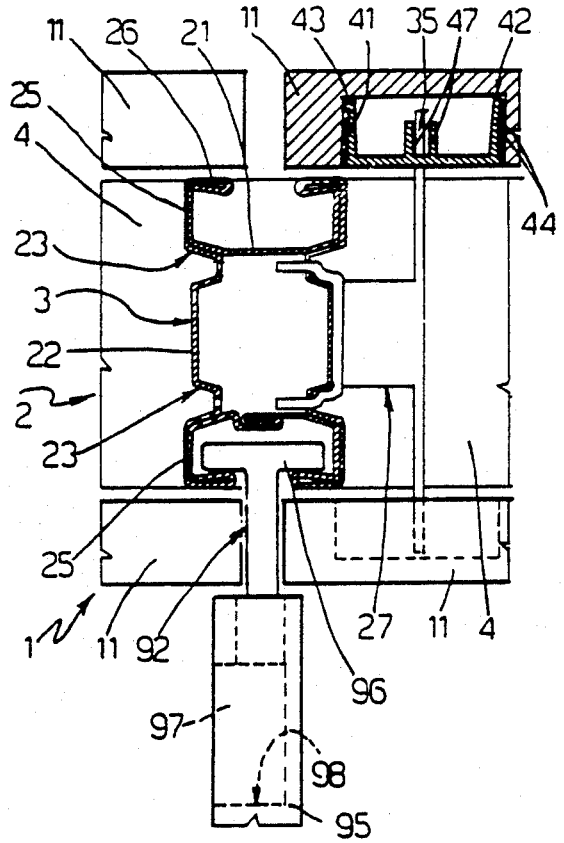
FIGS. 4 and 5 show partial side and plan views respectively of a vertical upright complete with a panel.
Figure 4:
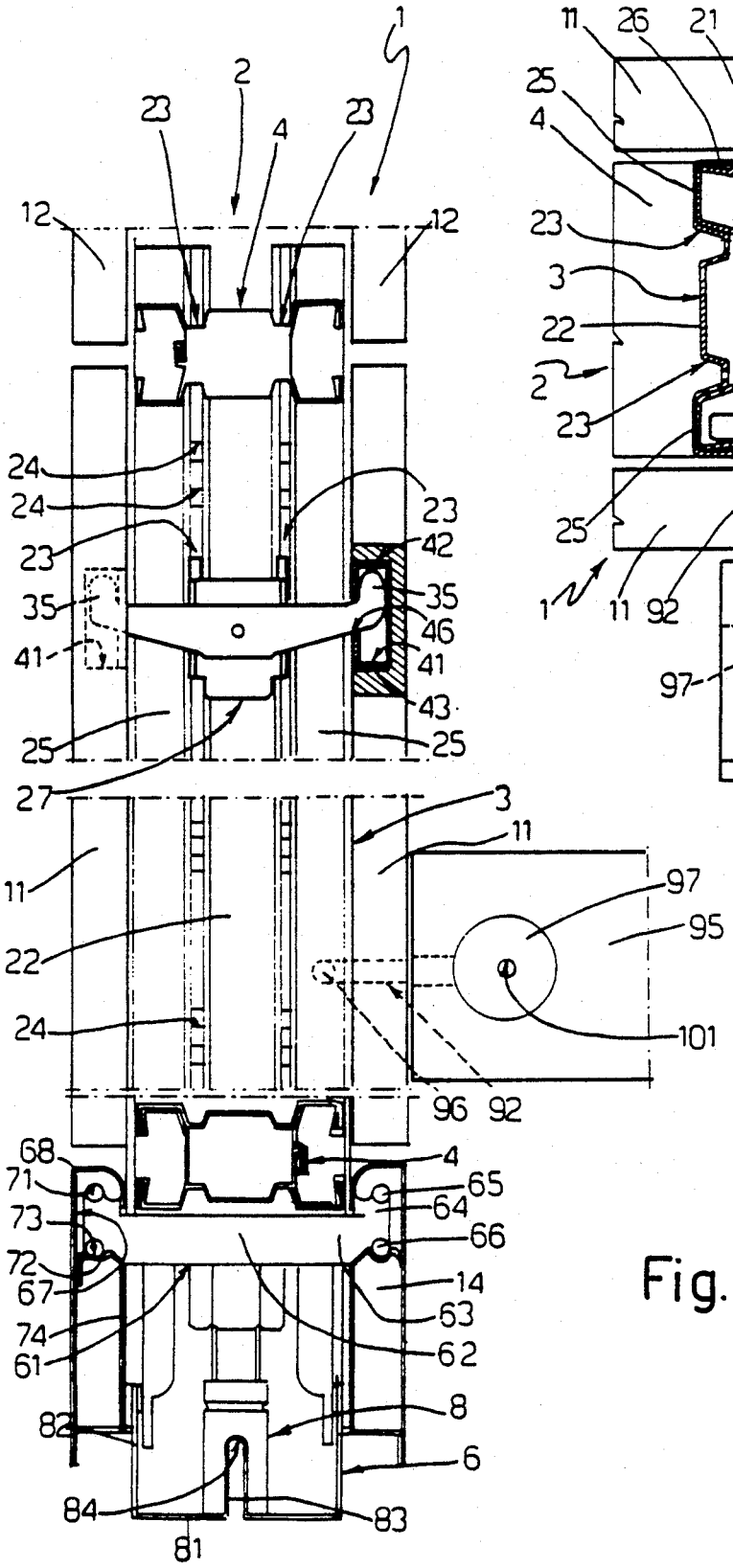
Figure 7:
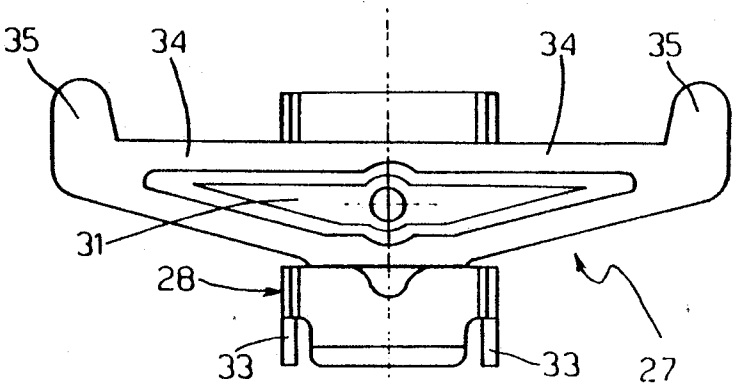
FIGS. 7 and 8 show front and plan views respectively of a fastening element between the vertical upright and panel.
Figure 8:
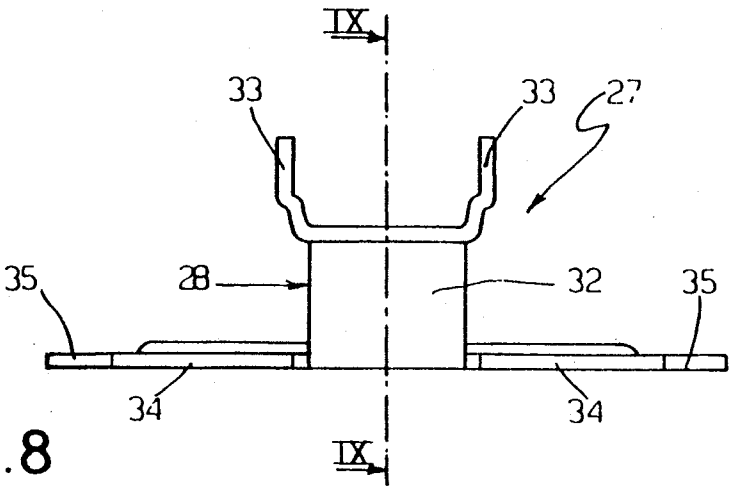
Figure 6:
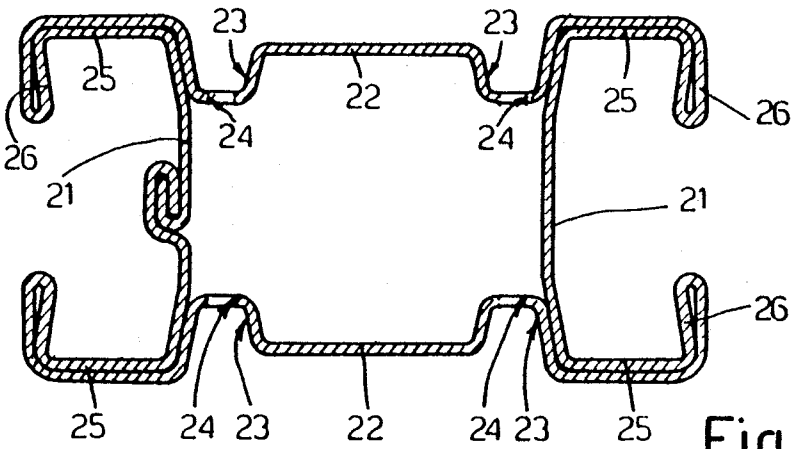
FIG. 6 shows a section of the FIG. 3 upright.
Figure 9:
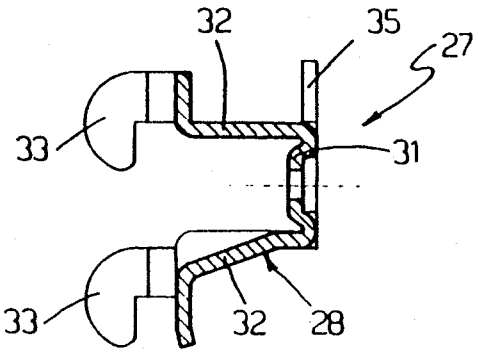
FIG. 9 shows a section along line IX—IX in FIG. 8.

Number 1 in FIGS. 1, 2 and 3 indicates a partition wall, particularly for offices, which is also designed to support various build-up furnishing fixtures enabling the formation of open or closed shelving, cupboards, drawers, filing cabinets, etc. Partition wall 1 comprises a frame 2 consisting of a number of pairs of vertical uprights 3 connected by a pair of crosspieces 4. In the example shown, frame 2 is substantially perpendicular to the floor, but may be arranged in the form of an L or any other configuration as required. Partition wall 1 comprises two faces consisting of a number of panels, preferably of wood, supported on frame 2 by means of original fasteners, and therefore panelling frame 2 on both faces. By means of further fasteners available on the market, and therefore not shown or only schematically in FIG. 3, frame 2 is also designed to support various build-up fixtures with which to furnish both faces of partition 1. As shown in FIG. 2, frame 2 presents a rectangular contour consisting of two horizontal metal bars 6 and two vertical metal bars 7. In the embodiment shown, the said contour encloses four vertical uprights 3, each having a springmounted top and bottom strut 8 adjustable in height and housed inside bottom bar 6 resting on the floor and top bar 6 which is normally pressed by top strut 8 against the ceiling. Each pair of adjacent uprights 3 is connected by a top and bottom horizontal crosspiece 4 close to struts 8. Between each pair of adjacent uprights 3, there are fitted a center panel 11 substantially closing the space between crosspieces 4; a smaller top panel 12 closing the space between top crosspiece 4 and top bar 6; and a bottom panel 13 closing the space between bottom crosspiece 4 and bottom bar 6. Each lateral end of frame 2 presents an end panel 14 closing the space between the first and last upright 3 and the respective bar 7, as shown in FIG. 2. With reference to FIGS. 3 to 6, uprights 3 and crosspieces 4 are formed from the same bent sheet metal section, the cross section of which presents a hollow center portion and two opposed, substantially C-shaped lateral portions. The said center portion presents a substantially rectangular contour defined by two first opposite side walls 21, which also define a respective said lateral portion, and by two second opposite side walls 22 the lateral edges of which present respective recesses 23 extending along the entire length of the section. Along each recess 23, there are formed a number of pairs of through slots 24 aligned with those on the other recesses 23. Each lateral portion of the said section is substantially C-shaped and defined by a center wall consisting of side wall 21, and by two arms 25, the ends 26 of which are bent perpendicularly so as to be substantially parallel with wall 21. The said section is formed by bending and folding a metal sheet, and clinching the longitudinal lateral edges along one of side walls 21. Consequently, walls 21 and 22 present the same thickness as the metal sheet, whereas arms 25 and the portions of walls 21 mating with the sides of recesses 23 are of double thickness. For forming the said section, the metal sheet is bent and folded as follows: commencing at one end, the sheet describes a first portion of wall 21, the inner side of recess 23, arm 25, and end portion 26, at which point it is folded back the same way on the outside up to the side of recess 23 from which it describes wall 22. At the end of wall 22, the sheet describes the outer side of the other recess 23 in wall 22, arm 25 and end portion 26, at which point it is folded back the same way on the inside up to the side of recess 23 from which it describes the other wall 21, and so on up to the first wall 21 where the two ends of the sheet are clinched. As shown in FIGS. 3 to 5 and 7 to 9, center panels 11 are supported on uprights 3 by means of a number of fasteners 27 formed by bending suitably shaped sheet metal. Each fastener 27 comprises a U-shaped center portion 28 having a center wall 31 parallel with wall 22 on upright 3, and a top and bottom side wall 32 substantially perpendicular to wall 22. The ends of walls 32 are turned outwards and support respective pairs of flat downturned teeth 33. From wall 31, there extend, coplanar with wall 31 and in opposite directions, two tapered tabs 34 the ends of which present a respective flat, upturned tooth 35. As shown in FIGS. 3 to 5, two aligned pairs of slots 24 along wall 22 of upright 3 are engaged, in use, by the four teeth 33 on fastener 27. Along both vertical side edges of panel 11, there are formed dead holes 41, into each of which is pressed a cup-shaped metal body 42 having a cylindrical side wall 43 the outer surface of which presents annular teeth 44 engaging hole 41. Body 42 also presents a bottom wall 45 in which is formed a rectangular through slot 46 through which tooth 35 of fastener 27 is inserted inside body 42 and housed between two tabs 47 extending on either side of slot 46 from bottom wall 45. If each side edge of panel 11 is fitted with three bodies 42, the two uprights 3 supporting panel 11 are fitted with three fasteners 27 at the same height as bodies 42 on panel 11, which, when assembled, thus rests on tabs 34 of fasteners 27 via bodies 42. Between top strut 8 and the respective axial end of upright 3, there is fitted a fastener 51 by means of which uprights 3 support top panels 12. The said fastener 51 consists of a U-shaped sheet metal plate having a center wall 52 housed between strut 8 and the end of upright 3, and two side walls 53 parallel with walls 22. From the vertical side edges of each wall 53, there extend in opposite directions respective coplanar tabs 54 similar to tabs 34 on fasteners 27 and also terminating with a respective flat, upturned tooth 55. The vertical side edges of top panel 12 present a respective body 42 engaged by tooth 55 of fastener 51. As shown in FIGS. 3 and 4, between bottom strut 8 and the respective axial end of upright 3, there is fitted a fastener 61 by means of which uprights 3 support bottom panels 13. Fastener 61 is substantially U-shaped and comprises a center wall (not shown) housed between strut 8 and the end of upright 3, and two side walls 62 parallel with walls 22. From the vertical side edges of each wall 62, there extend in opposite directions respective coplanar tabs 63 (FIG. 4) having an upturned end 64. Between the two pairs of opposite ends 64 on each fastener 61, there are fitted a top and bottom horizontal pin 65 and 66. Each vertical side edge of bottom panel 13 presents an open-sided cavity 67 housing a metal element 68 in the form of an inverted L and having a seat 71 engaged by pin 65 about which panel 13 pivots. At the bottom of element 68 inside cavity 67, there is fitted an elastically deformable plate 72 having a seat 73 inside which pin 66 is clicked. The inner face of panel 13 is covered with a layer 74 of soundproofing material. Panels 14 are supported by uprights 3 on either side of frame 2, and have only one vertical side edge fitted with bodies 42 engaging with fasteners 27 and 51 of uprights 3. As shown in FIGS. 3 and 4, bars 6 and 7 are formed from metal section and present a center wall 81 and two side walls 82. From the inner face of wall 81, there extends perpendicularly a projection 83 designed to engage a diametrical through slot 84 formed on the ends of struts 8. Between two adjacent panels 11, a gap exists (FIGS. 1 and 5) corresponding with the gap between ends 26 on the lateral portion of the upright 3 section supporting panels 11. Between panels 11 and respective panels 12 and 13, a similar gap exists corresponding with that between ends 26 on the lateral portion of the respective crosspiece 4 sections. As shown in FIG. 3, crosspieces 4 are fitted to uprights 3 by means of a fastener 85 having four flat teeth 86 as on fastener 27. Fastener 85 comprises an inner portion at the axial end of crosspiece 4 and integral with a lever 87 which, subsequent to engagement of slots 24 by teeth 86, is turned from the vertical position shown into a horizontal position, so as to draw teeth 86 inside crosspiece 4 ad so ensure firm assembly of the same to upright 3. Once partition wall 1 has been assembled, both faces may be furnished as required. A cupboard, for example, may be formed by assembling two side panels 91 of the same height as panels 11 and supported on respective upright 3 by means of a number of fasteners 92 (only one of which is shown in FIG. 3). Between the said two side panels 91, a door may be hinged in the usual way along the side edge of one panel 91. Shelving 93 may also be provided inside the cupboard and supported by panels 91 in the usual way (not shown). As panels 91 are raised off the floor, each must obviously be fitted with a foot 94. For forming open shelving 93, each shelf 93 is fitted in the usual way to two panels 95 (FIG. 4) narrower than panels 91 and supported on uprights 3 by means of fasteners 92, which are no more than eccentric ties as marketed, for example, by Confalonieri S.r.l. of Guissano (Milan). These consist substantially of a T-shaped head 96 which is inserted inside the lateral portion of the upright 3 section, and a shank having a helical profile extending inside a bush 97 fitted inside a hole 98 on the vertical side edge of panel 91 or 95. Bush 97 presents an axial seat 101 for an Allen wrench with which to pull on the shank. In this way, pull is exerted on the whole of fastener 92, and head 96 is pressed on to the ends 26 of arms 25 on the lateral portion of the upright 3 section. Panels 91 and 95 may of course be assembled using other fastening means designed to exploit the special design of the lateral portion of the upright 3 section. The numerous advantages of the present invention will be clear from the foregoing description. In particular, the design of the upright 3 section provides for fast, troublefree assembly of partition wall 1 using the fasteners described, which are also easy to produce. Once partition 1 has been assembled, one or both faces may be furnished easily and quickly as required. Another important feature to note is that the design of bars 6 provides for housing electric cables, which may be run along the lateral portion of the upright 3 section and out at any height as required. The panel 13 assembly system enables inspection of the bottom of partition 1 and therefore also of any electric cables housed inside the same. Finally, the extremely versatile design of partition 1 provides for any number of configurations using the same components. To those skilled in the art it will be clear that changes may be made to partition 1 as described herein without, however, departing from the scope of the present invention.

We claim:

1. A partition wall comprising a self-supporting preassembled frame having first and second opposite lateral surfaces, at least one panel extending outside and along each said lateral surface, and first fastening means to releasably connect the panels to said frame; said frame comprising a number of elongated bars defining vertical uprights, and horizontal upper and lower crosspieces connecting the uprights in pairs; and each elongated bar having two lateral outer substantially parallel walls and two inner substantially parallel transverse walls extending between said two outer walls, and defining therewith a substantially rectangular tubular center portion and two opposed substantially C-shaped lateral portions of said elongated bar; said two outer walls extending transversely of the lateral surfaces of said frame, and having turned-in opposite longitudinal end portions each arranged substantially in contact with an inner surface of a respective said panel, and wherein each elongated bar is formed from a single elongated metal sheet having opposite longitudinal lateral edges, the sheet having been transversely bent to form said two outer walls and said two inner walls, and said longitudinal lateral edges having been clinched together at one of said inner walls.

2. A partition wall comprising a self-supporting preassembled frame having first and second opposite lateral surfaces, at least one panel extending outside and along each said lateral surface, and first fastening means to releasably connect the panels to said frame; said frame comprising a number of elongated bars defining vertical uprights, and horizontal upper and lower crosspieces connecting the uprights in pairs; and each elongated bar having two lateral outer substantially parallel walls and two inner substantially parallel transverse walls extending between said two outer walls, and defining therewith a substantially rectangular tubular center portion and two opposed substantially C-shaped lateral portions of said elongated bar; said two outer walls extending transversely of the lateral surfaces of said frame, and having turned-in opposite longitudinal end portions each arranged substantially in contact with an inner surface of a respective said panel, and wherein, along each said outer wall of each said upright, two longitudinal rows of equally spaced through slots are provided; said first fastening means comprising at least a first element having at least two first teeth engaging respective said slots, and two opposed transverse first tabs extending parallel with the respective said outer wall and towards an inner surface of a respective said panel; said inner surface being provided with first socket means, and each said first tab being provided with a respective second tooth engaging a respective said first socket means.

3. A partition wall as claimed in claim 2, wherein each said upright has longitudinal top and bottom ends provided with top and bottom struts extending above said upper crosspieces and below said lower crosspieces respectively; each pair of adjacent uprights and the connecting upper and lower crosspieces defining an intermediate space extending between the upper and lower crosspieces, an upper space extending above said upper crosspiece and between said top struts, and a lower space extending below said lower crosspiece and between said bottom struts; each said panel being an intermediate panel connected to a respective pair of adjacent uprights by said first fastening means to close a respective said intermediate space.

4. A partition wall as claimed in claim 3, further comprising upper and lower panels connected to said uprights by said first fastening means to close said upper and lower spaces respectively.

5. A partition wall as claimed in claim 4, wherein said first fastening means further comprises a second element, fitted to the upper end of each upright, having a transverse central wall through which said top strut extends, and at least two opposed transverse second tabs rigid with said central wall, and extending parallel with a respective said outer wall of said upright and towards an inner surface of a respective said upper panel; this inner surface being provided with second socket means, and each said second tab being provided with a respective third tooth engaging a respective said second socket means.

6. A partition wall as claimed in claim 4, wherein said first fastening means further comprises a third element, fitted to the lower end of each upright, having a transverse central wall through which said bottom strut extends, and at least two opposed side walls each extending parallel with a respective said outer wall of said upright; a pin being supported by said two side walls at each lateral surface of said frame and facing an inner surface of a respective said lower panel; said inner surface being provided with hook means, and each said pin being engaged by a respective said hook menas to hang said lower panel to said frame.

7. A partition wall comprising a self-supporting preassembled frame having first and second opposite lateral surfaces, at least one panel extending outside and along each said lateral surface, and first fastening means to releasably connect the panels to said frame; said frame comprising a number of elongated bars defining vertical uprights, and horizontal upper and lower crosspieces connecting the uprights in pairs; and each elongated bar having two lateral outer substantially parallel walls and two inner substantially parallel transverse walls extending between said two outer walls, and defining therewith a substantially rectangular tubular center portion and two opposed substantially C-shaped lateral portions of said elongated bar; said two outer walls extending transversely of the lateral surfaces of said frame, and having turned-in opposite longitudinal end portions each arranged substantially in contact with an inner surface of a respective said panel, and wherein, along each said outer wall of each said upright, two longitudinal rows of equally spaced through slots are provided; each crosspiece having longitudinal ends each provided with second fastening means for connection of the crosspiece to a respective said upright; and each second fastening means comprising a body, a first portion of which is housed inside said crosspiece, and a second portion of which extends axially outside the crosspiece, and is provided with two teeth each engaging a corresponding said slot, and lever means to draw said first portion into said crosspiece.

8. A partition wall comprising a self-supporting, preassembled frame having first and second opposite lateral surfaces, at least one panel extending outside and along each said lateral surface, at least one further panel to define furnishing fixtures, and first and second fastening means to releasably connect said panels and said further panel to the frame; the frame comprising a number of elongated bars defining vertical uprights, and horizontal upper and lower crosspieces, each upper crosspiece and a corresponding lower crosspiece extending between a respective pair of adjacent uprights, and third fastening means being provided to connect said crosspieces to said uprights; each elongated bar having two lateral outer substantially parallel walls and two inner substantially parallel transverse walls extending between said two outer walls, and defining therewith a substantially rectangular tubular center portion and two opposed substantially C-shaped lateral portions of said elongated bar; said two outer walls extending transversely of the lateral surfaces of the frame, and having turned-in opposite longitudinal end portions each arranged substantially in contact with an inner surface of a respective said panel; and each second fastening means engaging a respective lateral portion of a respective said bar, and extending between the turned-in opposite longitudinal end portions thereof, and further comprising an outer frame enclosing said frame; each said upright having longitudinal top and bottom ends provided with top and bottom struts extending to said outer frame above said upper crosspieces and below said lower crosspieces respectively; each pair of adjacent uprights and the connecting upper and lower crosspieces defining an intermediate space extending between the upper and lower crosspieces, an upper space extending between said upper crosspiece and the outer frame and between said top struts, and a lower space extending between said lower crosspiece and the outer frame and between said bottom struts; each said panel being an intermediate panel connected to a respective pair of adjacent uprights by said first fastening means to close a respective said intermediate space, and upper and lower panels being provided, which are connected to said uprights by said first fastening means to close said upper and lower spaces respectively.

* * * * *